US012202579B1

(12) United States Patent
Stull

(10) Patent No.: US 12,202,579 B1
(45) Date of Patent: Jan. 21, 2025

(54) WATERCRAFT

(71) Applicant: Donald P Stull, Stevenson, WA (US)

(72) Inventor: Donald P Stull, Stevenson, WA (US)

( * ) Notice: Subject to any disclaimer, the term of this patent is extended or adjusted under 35 U.S.C. 154(b) by 95 days.

(21) Appl. No.: 18/137,911

(22) Filed: Apr. 21, 2023

(51) Int. Cl.
*B63B 34/26* (2020.01)
*B63B 17/02* (2006.01)

(52) U.S. Cl.
CPC ..... *B63B 34/26* (2020.02); *B63B 2017/026* (2013.01); *B63B 2221/22* (2013.01)

(58) Field of Classification Search
None
See application file for complete search history.

(56) References Cited

U.S. PATENT DOCUMENTS

2016/0368571 A1* 12/2016 Levin ..... E04H 15/18
2019/0283843 A1* 9/2019 Greer ..... B63J 99/00
2022/0281560 A1* 9/2022 Rogers ..... B63B 17/02

FOREIGN PATENT DOCUMENTS

CA 3006121 A1 * 12/2018 ..... B63B 17/02

* cited by examiner

*Primary Examiner* — S. Joseph Morano
*Assistant Examiner* — Jovon E Hayes
(74) *Attorney, Agent, or Firm* — Plager Schack LLP; Mark H. Plager, Esq.; Michael J. O'Brien, Esq.

(57) ABSTRACT

A watercraft assembly is configured to provide an area protected from splashing water and sunlight. The watercraft assembly has a kayak with an open bow. A canopy assembly attached to the open bow. The canopy assembly further comprising a lower rod attached to the bow with a line clamp. A mounting bracket assembly is arranged above the line clamp, and joined to a small rod and a large rod. A canopy tarp is arranged over the lower rod, the small rod and the large rod wherein the canopy tarp covers a protected area protecting the protected area from water splashing and sunlight.

9 Claims, 6 Drawing Sheets

WATERCRAFT

BACKGROUND

The embodiments herein relate generally to vessel design and construction.

Prior to embodiments of the disclosed invention, the deck near the bow of a kayak would get wet and hot in the sun. Embodiments of the disclosed invention solve these problems.

SUMMARY

A watercraft assembly is configured to provide an area protected from splashing water and sunlight. The watercraft assembly has a kayak with an open bow. A canopy assembly attached to the open bow. The canopy assembly further comprising a lower rod attached to the bow with a line clamp. A mounting bracket assembly is arranged above the line clamp and joined to a small rod and a large rod. A canopy tarp is arranged over the lower rod, the small rod and the large rod wherein the canopy tarp covers a protected area protecting the protected area from water splashing and sunlight.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
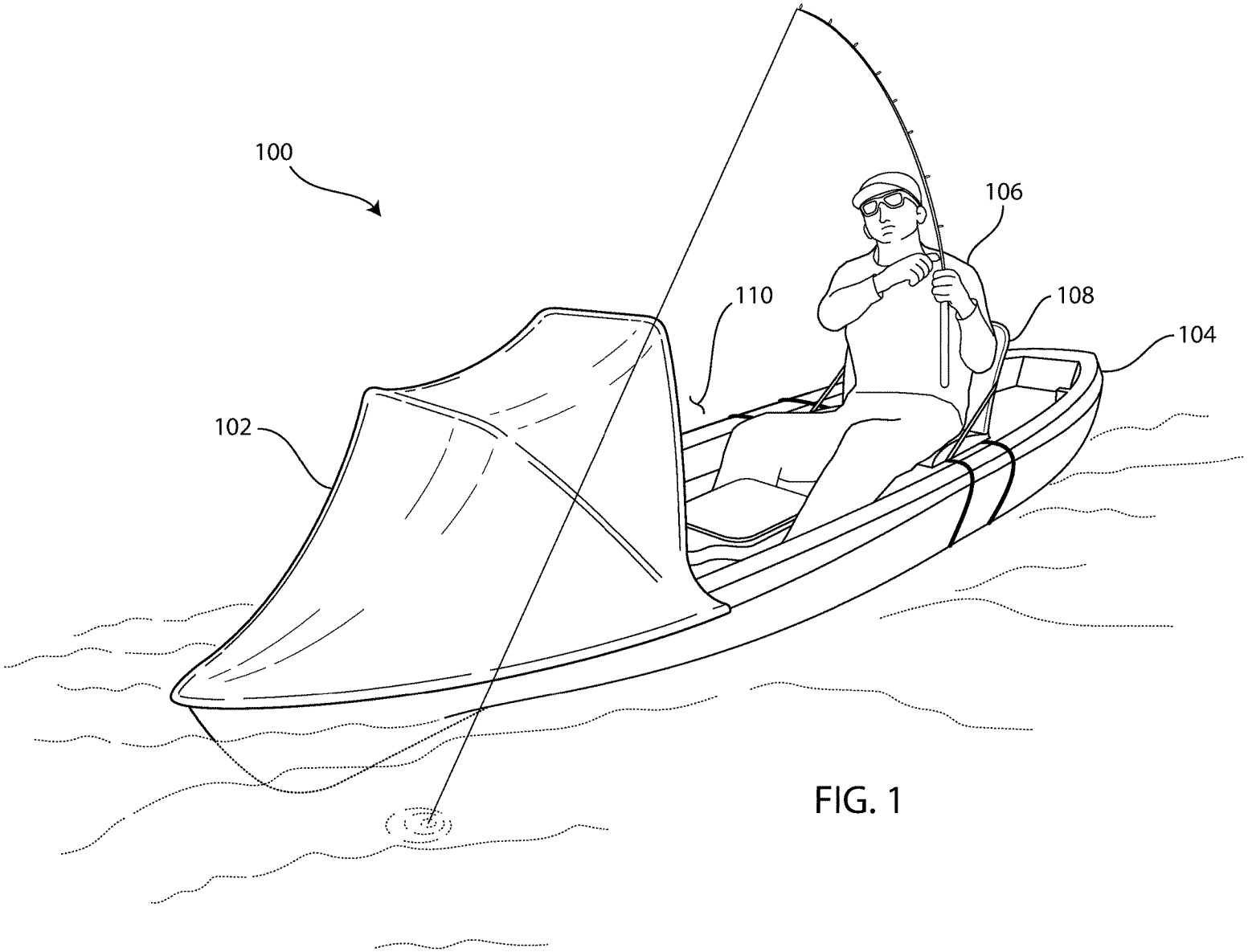
FIG. 1 shows a perspective view of one embodiment of the present invention shown in use.
Figure 2:
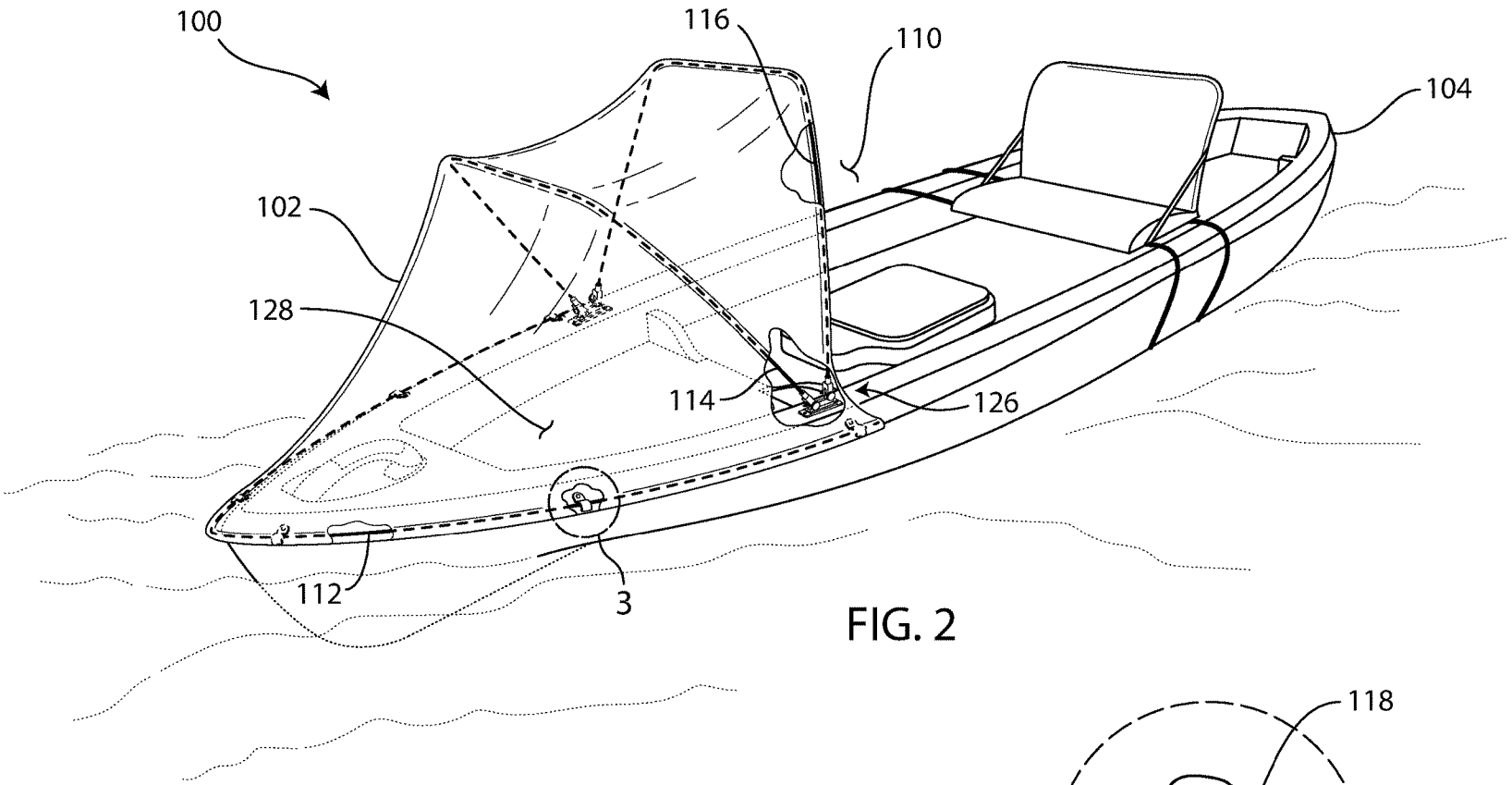
FIG. 2 shows all the rods running through the canopy material, and the lower rod attached to the present invention.
Figure 3:
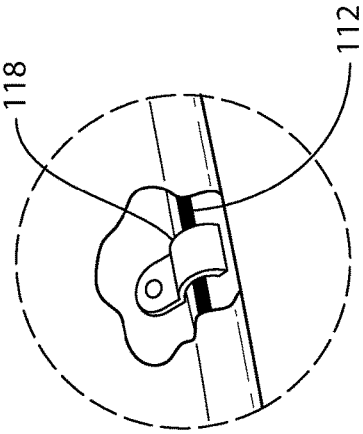
FIG. 3 shows a detailed view of the line clamp holding lower rod with canopy to bow of the present invention.
Figure 4:
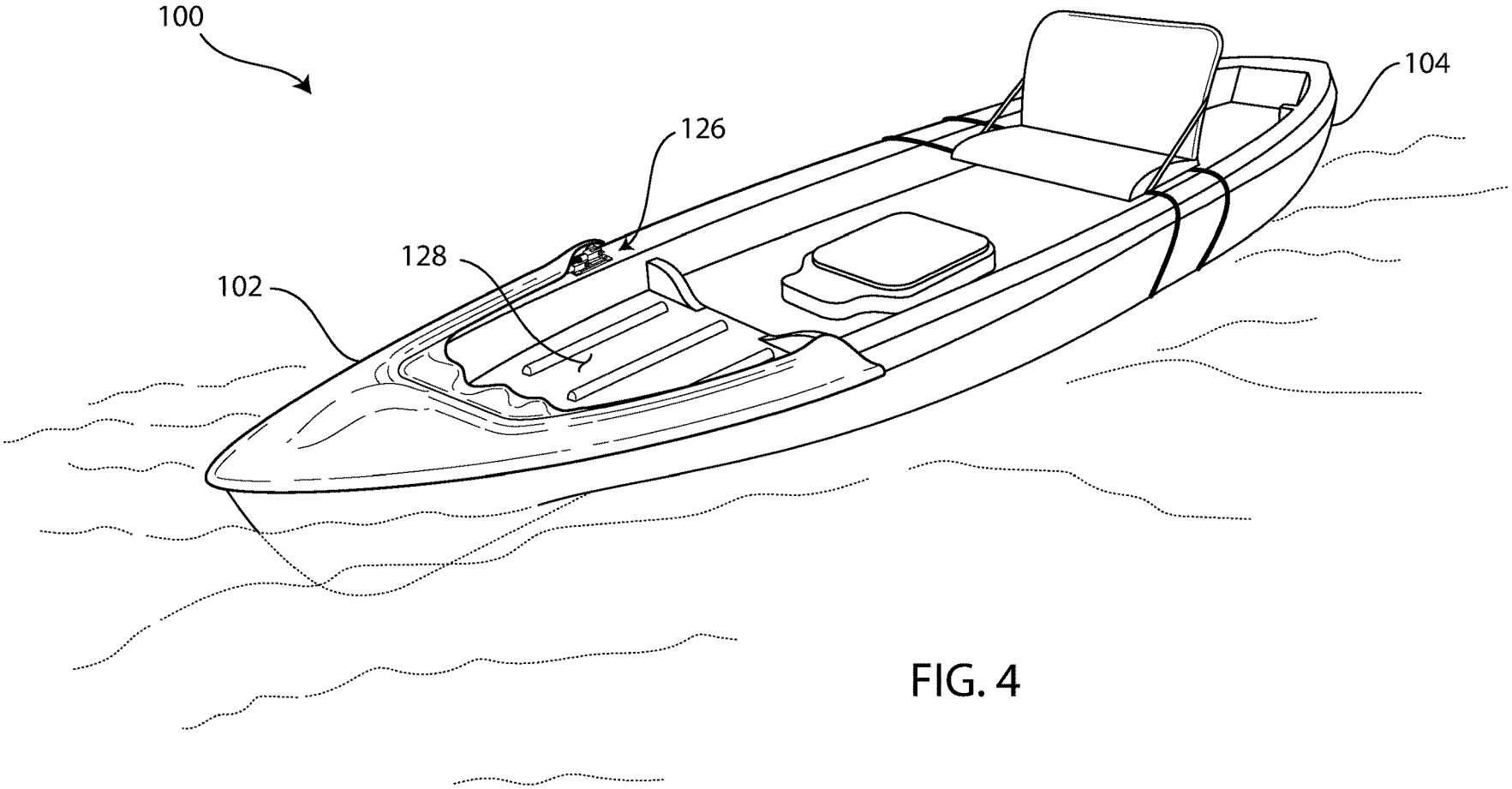
FIG. 4 shows a canopy in the down position when not in use.
Figure 5:
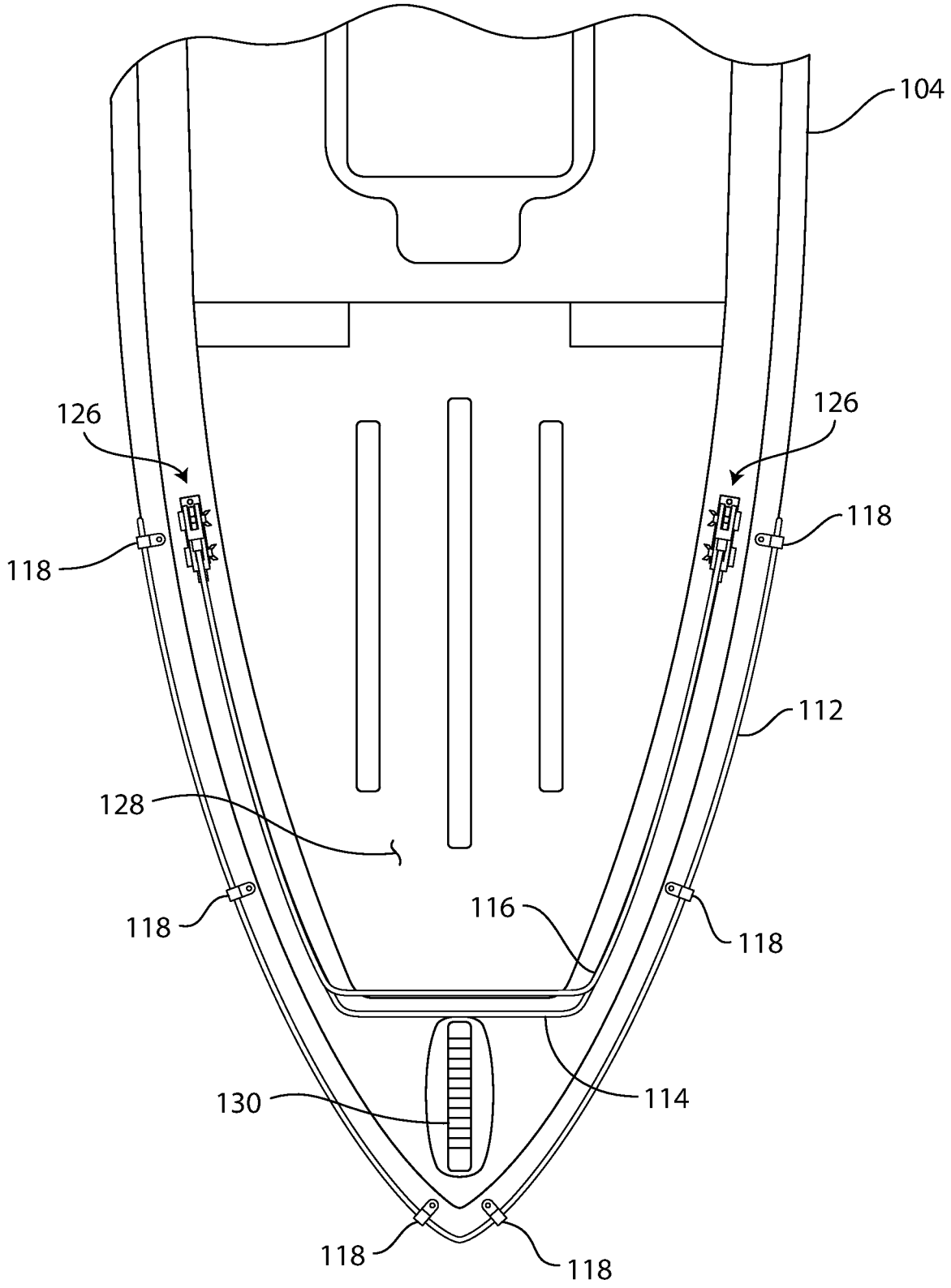
FIG. 5 shows a canopy bracket with lower, small and large rod shape and position.
Figure 6:
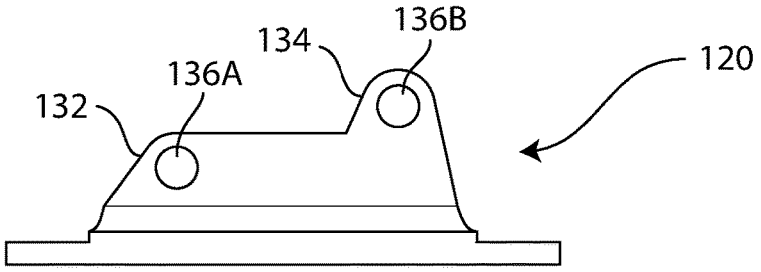
FIG. 6 shows a side view of a mounting bracket.
Figure 7:
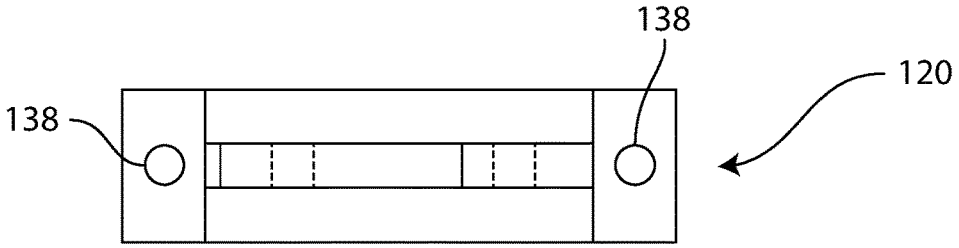
FIG. 7 shows a top view of a mounting bracket.
Figure 8:
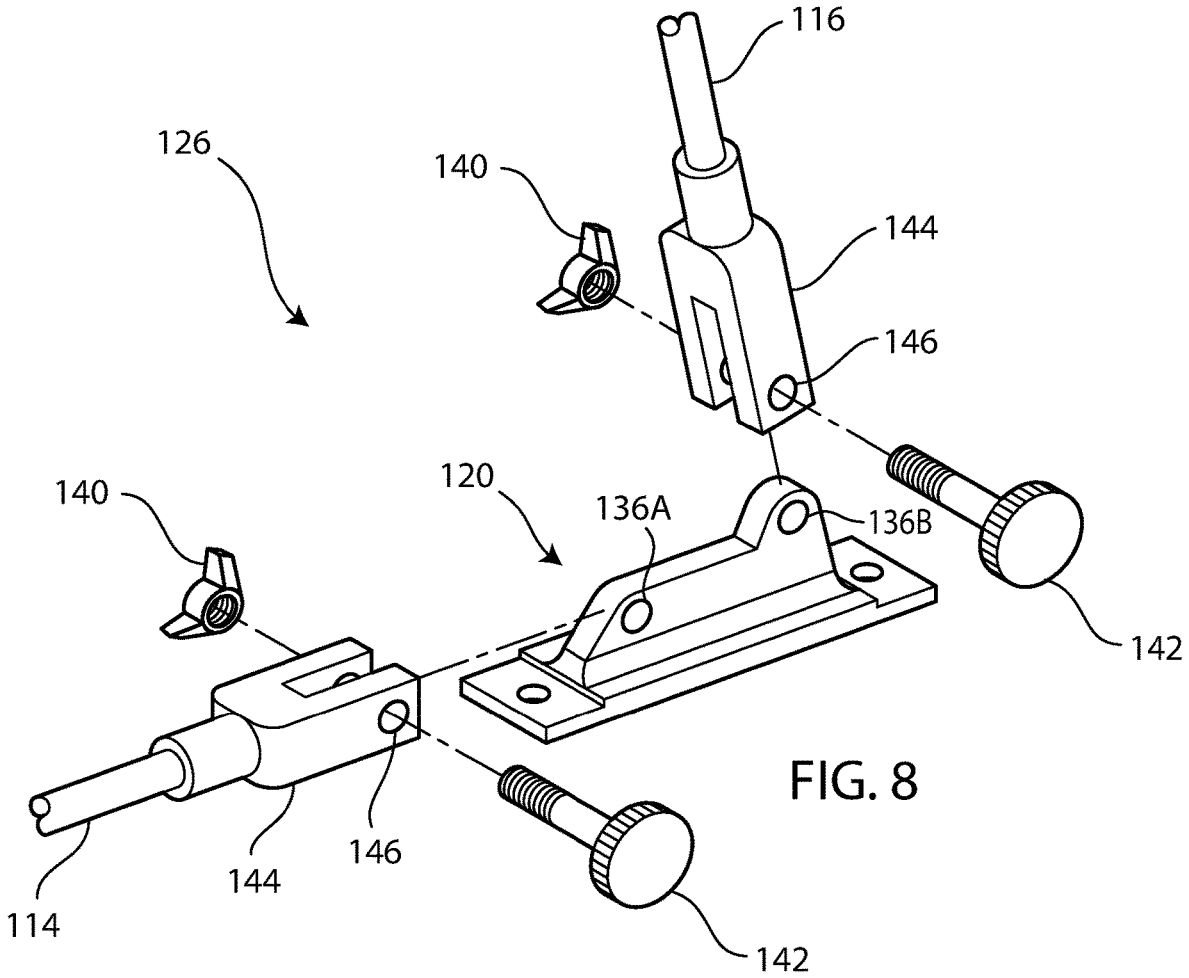
FIG. 8 shows an assembly view of a mounting bracket.
Figure 9:
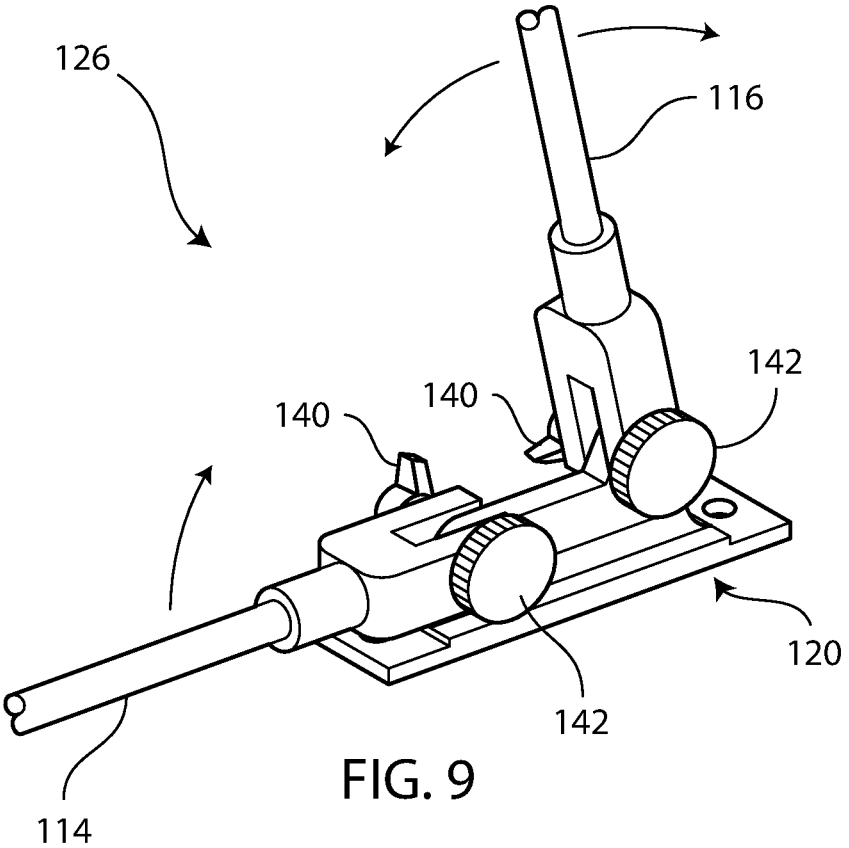
FIG. 9 shows a perspective view of a mounting bracket in the opening position.
Figure 10:
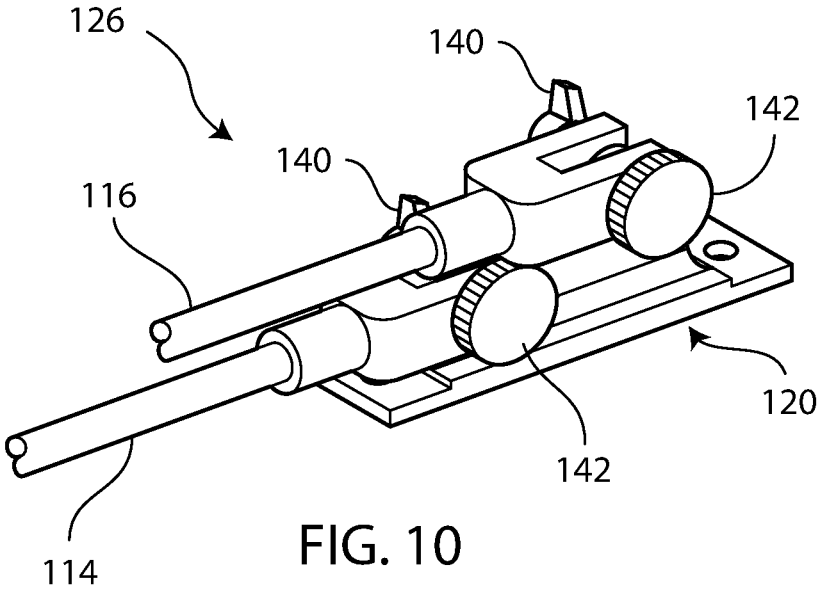
FIG. 10 shows a perspective view of a mounting bracket in the close or not in use position.

By way of example, and referring to FIGS. 1-10, one embodiment of a watercraft assembly 100 comprises kayak 104 joined to seat 108 upon which fisher 106 can sit. A canopy 102 is attached to a bow of the kayak 104 having a canopy opening 110.

The canopy 102 further comprises a lower rod 112 attached to the bow with a line clamp 118. A mounting bracket assembly 126, is arranged above the proximate to the line clamp 118. The mounting bracket assembly 126 is joined to a small rod 114 and a large rod 116. A canopy tarp is arranged over the lower rod 112, the small rod 114 and the large rod 116. Beneath the canopy is a protected area 128 which the canopy 102 protects from water splashing and sunlight. Numerous line clamps 118 are attached around a bow securing the lower rod and canopy to the kayak 104.

The mounting bracket assembly 126 comprises a mounting bracket 120. The mounting bracket 120 further comprises a bracket lower flange 132 and a bracket upper flange 134. The bracket lower flange 132 further comprises a first opening 136A. The bracket upper flange 134 further comprises a second opening 136B.

Small rod 114 is attached to a small rod bracket clip 144. The small rod bracket clip 144 is attached to the bracket lower flange 132 with a threaded knurled knob 142 through a mounting bracket opening 146 and through the lower opening 136A and secured with a wing nut 140.

Large rod 116 is attached to a large rod bracket clip 144. The large rod bracket clip 144 is attached to the bracket upper flange 134 with a threaded knurled knob 142 through a mounting bracket opening 146 and through the upper opening 136B and secured with a wing nut 140.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A watercraft assembly is configured to provide an area protected from splashing water and sunlight; the watercraft assembly comprising:

a kayak with an open bow;

a canopy assembly attached to the open bow; the canopy assembly further comprising: a lower rod attached to the bow with a line clamp;

a mounting bracket assembly, arranged above the line clamp, and joined to a first rod and a second rod;

a canopy tarp, arranged over the lower rod, the first rod and the second rod wherein the canopy tarp covers a protected area protecting the protected area from water splashing and sunlight.

2. The watercraft assembly of claim 1, further comprising: numerous line clamps, attached around a bow securing the lower rod and canopy to the kayak.

3. The watercraft assembly of claim 2, wherein the mounting bracket assembly comprises a mounting bracket with holes for first and second rods.

4. The watercraft assembly of claim 3, wherein the mounting bracket further comprises a bracket lower flange and a bracket upper flange.

5. The watercraft assembly of claim 4, wherein the bracket lower flange further comprises a first opening, and the bracket upper flange further comprises a second opening.

6. The watercraft assembly of claim 5, further comprising a first rod bracket clip attached to the bracket lower flange with a threaded knurled knob through a mounting bracket opening and through the lower opening and secured with a wing nut.

7. The watercraft assembly of claim 6, further comprising a first rod attached to the first rod bracket clip.

8. The watercraft assembly of claim 7, further comprising a second rod bracket clip attached to the upper bracket lower flange with a threaded knurled knob through a mounting bracket opening and through the upper opening and secured with a wing nut.

9. The watercraft assembly of claim 8, further comprising a second rod attached to the second rod bracket clip.

* * * * *